US007671540B2

(12) United States Patent
Lee et al.

(10) Patent No.: US 7,671,540 B2
(45) Date of Patent: Mar. 2, 2010

(54) CURRENT BALANCING MODULE

(75) Inventors: Chih-Shun Lee, Taipei (TW); Chien-Pang Hung, Taipei (TW)

(73) Assignee: Beyond Innovation Technology Co., Ltd., Taipei (TW)

( * ) Notice: Subject to any disclaimer, the term of this patent is extended or adjusted under 35 U.S.C. 154(b) by 260 days.

(21) Appl. No.: 12/031,714

(22) Filed: Feb. 15, 2008

(65) Prior Publication Data

US 2008/0296972 A1 Dec. 4, 2008

(30) Foreign Application Priority Data

May 31, 2007 (TW) ..... 96119507 A

(51) Int. Cl.
*H05B 41/24* (2006.01)
*H05B 41/16* (2006.01)

(52) U.S. Cl. ..... 315/282; 315/257; 315/277

(58) Field of Classification Search ..... 315/224, 315/255, 257, 274, 275, 277, 282, 324
See application file for complete search history.

(56) References Cited

U.S. PATENT DOCUMENTS 6,781,325 B2 8/2004 Lee
6,954,364 B2 * 10/2005 Min ..... 363/56.08

* cited by examiner

*Primary Examiner*—Gary L Laxton
(74) *Attorney, Agent, or Firm*—Winston Hsu

(57) ABSTRACT

For having magnitudes of all currents for supplying for all passive elements in a same product be equal, a current balancing module, which has balancing transformers as more as approximately half an amount of all the passive elements, is provided for meeting such requirements. The provided current balancing module is for solving defects caused by complicated designs and increased volumes caused by an increased number of balancing transformers. Each current path in the current balancing module flows through two mutual-corresponding passive elements and at least one balancing transformer. All the current paths have a same magnitude in current with the aid of a pair of sinusoidal waves having same magnitudes and opposite poles, and the aid of all the balancing transformers having a same number of turns.

25 Claims, 9 Drawing Sheets

CURRENT BALANCING MODULE

BACKGROUND OF THE INVENTION

1. Field of the Invention

The present invention relates to a current balancing module, and more particularly, to a current balancing module utilizing fewer balancing transformers.

2. Description of the Prior Art

In a conventional liquid crystal television utilizing a huge amount of tubes as back light modules, a primary transformer is required for supplying power to all the tubes. The magnitude of each current flowing through each tube is required to be as close as possible for having luminance of each tube be consistent. However, since there are possible differences among the tubes because of fabrication, resistances of the tubes may reveal differences as well. Differences in resistances of the tubes result in differences in magnitudes of currents flowing through the tubes so that consistency and stability in luminance of the tubes fail, and the quality for watching the liquid crystal television is significantly reduced. For neutralizing such defects, more balancing transformers are added to the tubes so as to balance currents flowing through the tubes. However, the added balancing transformers increase the capital, the volume, and power consumption of the liquid crystal television.

Please refer to FIG. 1, which is a diagram of a conventional current balancing module 100 equipping balancing transformers for balancing magnitudes of currents flowing through tubes of a liquid crystal television. As shown in FIG. 1, the current balancing module 100 includes a primary transformer 102, a plurality of capacitors 104, a plurality of tubes 106 respectively corresponding to the plurality of capacitors 104, and a plurality of balancing transformers 108 respectively corresponding to the plurality of tubes 106. The primary transformer 102 is used for raising voltage levels of inputted voltages for lightening the plurality of tubes 106. The plurality of capacitors 104 is utilized for filtering off DC components and harmonic wave components in outputted voltages of the primary transformer 102. The balancing transformer 108 is utilized for modulating the magnitude of the current flowing through each tube 106 with a turns ratio (or a circle ratio) of 1:1 so as to balance the magnitude of the current flowing through each tube 106. However, as shown in FIG. 1, a balancing transformer 108 is required by each tube 106 for cooperating with the modulated current, which creates burdens in volume and fabrication capital. Moreover, the more the number of the plurality of tubes 106 is, the heavier the burden is.

Please refer to FIG. 2, which is a diagram of a conventional current balancing module disclosed in U.S. Pat. No. 6,781,325. As shown in FIG. 2, the DC voltage source 200 is utilized for providing DC voltages for the full bridge circuit 202 so as to transform the DC voltages into square waves, and the transformer 204 is utilized for transforming the voltage level of the DC voltages. A plurality of capacitors $C_1, C_2, C_3, \ldots, C_n$, each of which is successively coupled to the output terminal of the transformer 204, is coupled to a plurality of corresponding tubes $CCFL_1, CCFL_2, CCFL_3, \ldots, CCFL_n$ respectively in series. A plurality of balancing transformers (or common-mode transformers) $CC_1, CC_2, CC_3, \ldots, CC_{n-1}$ is utilized for balancing magnitudes of currents flowing through the tubes $CCFL_1, CCFL_2, CCFL_3, \ldots, CCFL_n$. A passive element module 220 is utilized for receiving a feedback signal, and a controller of the full bridge circuit 202 outputs voltages according to the feedback signal. Therefore, as can be observed in FIG. 2, the magnitudes of currents $I_1$ and $I_2$ are equivalent, and the magnitudes of currents $I_3$ and $I_4$ are equivalent as well. However, though the magnitudes of the currents flowing through the plurality of tubes $CCFL_1, CCFL_2, CCFL_3, \ldots, CCFL_n$ are balanced to a certain degree, numbers of balancing transformers on certain current paths are not consistent with the most current paths so that the degree of balancing is reduced slightly. Moreover, since the design of the conventional current balancing modules is getting complicated, the volume of utilized elements is also enlarged with the increased number of tubes, and the above-mentioned defects cannot be herein neutralized effectively.

SUMMARY OF THE INVENTION

The claimed invention discloses a current balancing module. The current balancing module comprises a first transforming element, a second transforming element, a plurality of first passive devices, a plurality of second passive devices, and a plurality of third transforming elements. The first transforming element has a first input terminal and a second input terminal. The second transforming element has a first input terminal coupled to the second input terminal of the first transforming element, and a second input terminal coupled to the first input terminal of the first transforming element. Each of the plurality of first passive devices has a first terminal coupled to the first output terminal of the first transforming element. Each of the plurality of second passive devices has a first terminal coupled to the first output terminal of the second transforming element, and a second terminal coupled to the second terminal of a corresponding first passive device. Each of the plurality of third transforming elements has a side connected in series with a corresponding first passive device and a corresponding second passive device.

The claimed invention also discloses a current balancing module. The current balancing module comprises a first transforming element, a second transforming element, two first passive devices, two second passive devices, and a third transforming element. The first transforming element has a first input terminal and a second input terminal. The second transforming element has a first input terminal coupled to the second input terminal of the first transforming element, and a second input terminal coupled to the first input terminal of the first transforming element. Each of both the two passive devices has a first terminal coupled to the first output terminal of the first transforming element. Each of the two second passive devices has a first terminal coupled to the first output terminal of the second transforming element, and a second terminal coupled to the second terminal of a corresponding first passive device. The third transforming element has one side coupled in series with both the first corresponding passive device and a second corresponding passive device.

These and other objectives of the present invention will no doubt become obvious to those of ordinary skill in the art after reading the following detailed description of the preferred embodiment that is illustrated in the various figures and drawings.

DETAILED DESCRIPTION

Therefore, a current balancing module is disclosed in the present invention for neutralizing the defect of complicated design and enlarged volume along with increased number of elements and tubes in the conventional current balancing modules.

Figure 1:
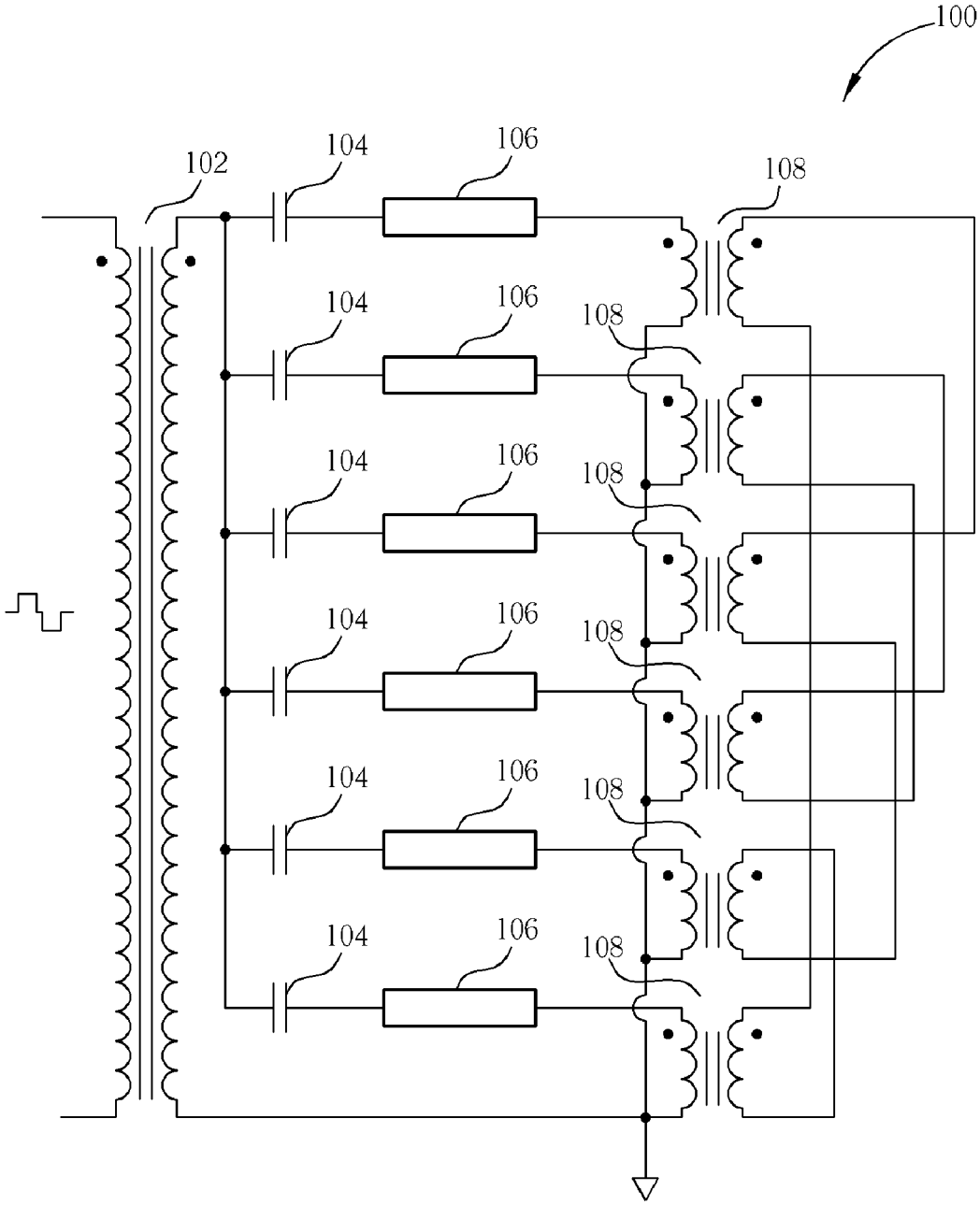
Fig. 1 Prior Art
FIG. 1 is a diagram of a conventional current balancing module having balancing transformers for balancing magnitudes of currents flowing through tubes of a liquid crystal television.
Figure 2:
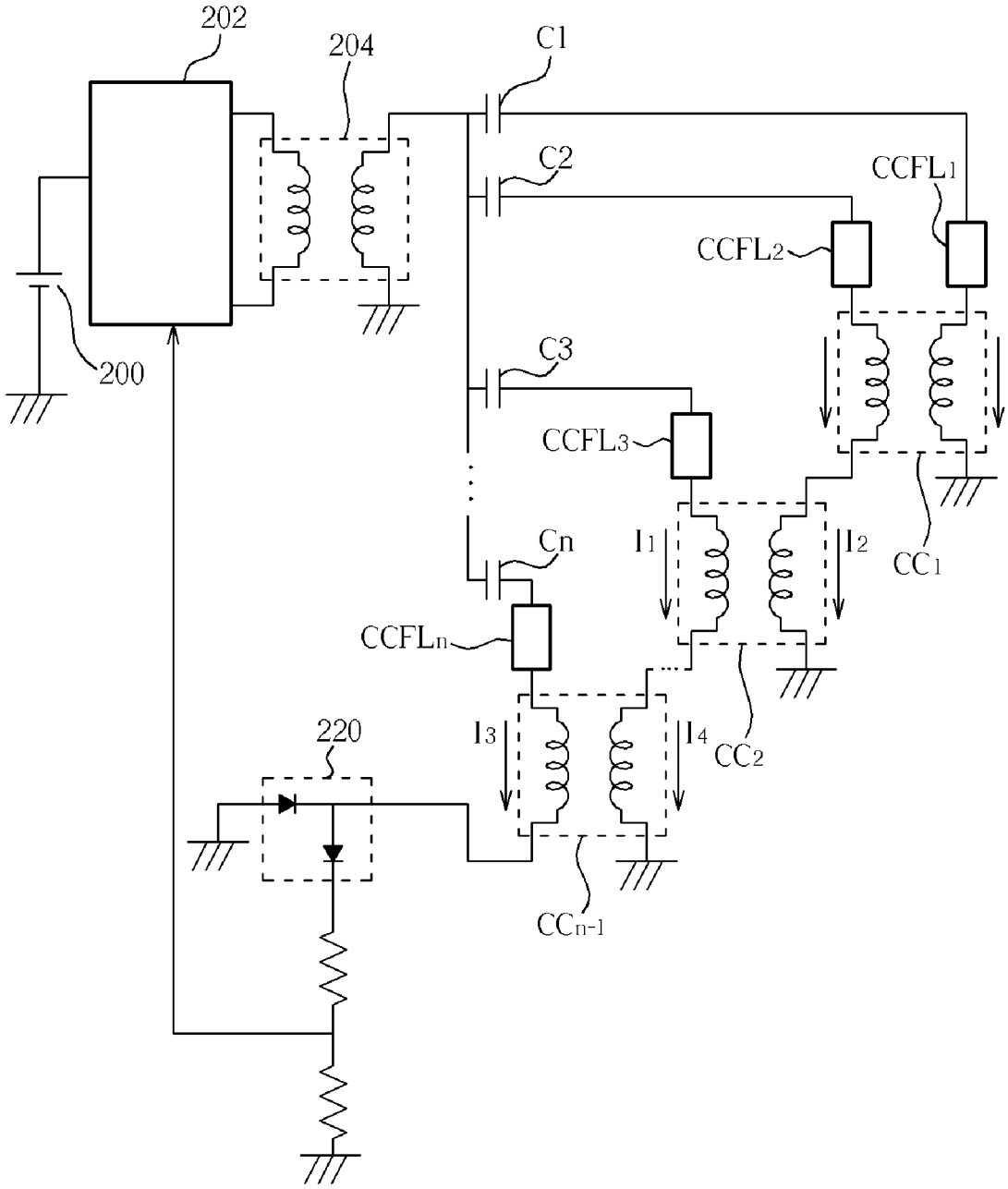
Fig. 2 Prior Art
FIG. 2 is a diagram of a conventional current balancing module disclosed in U.S. Pat. No. 6,781,325.
Figure 3:
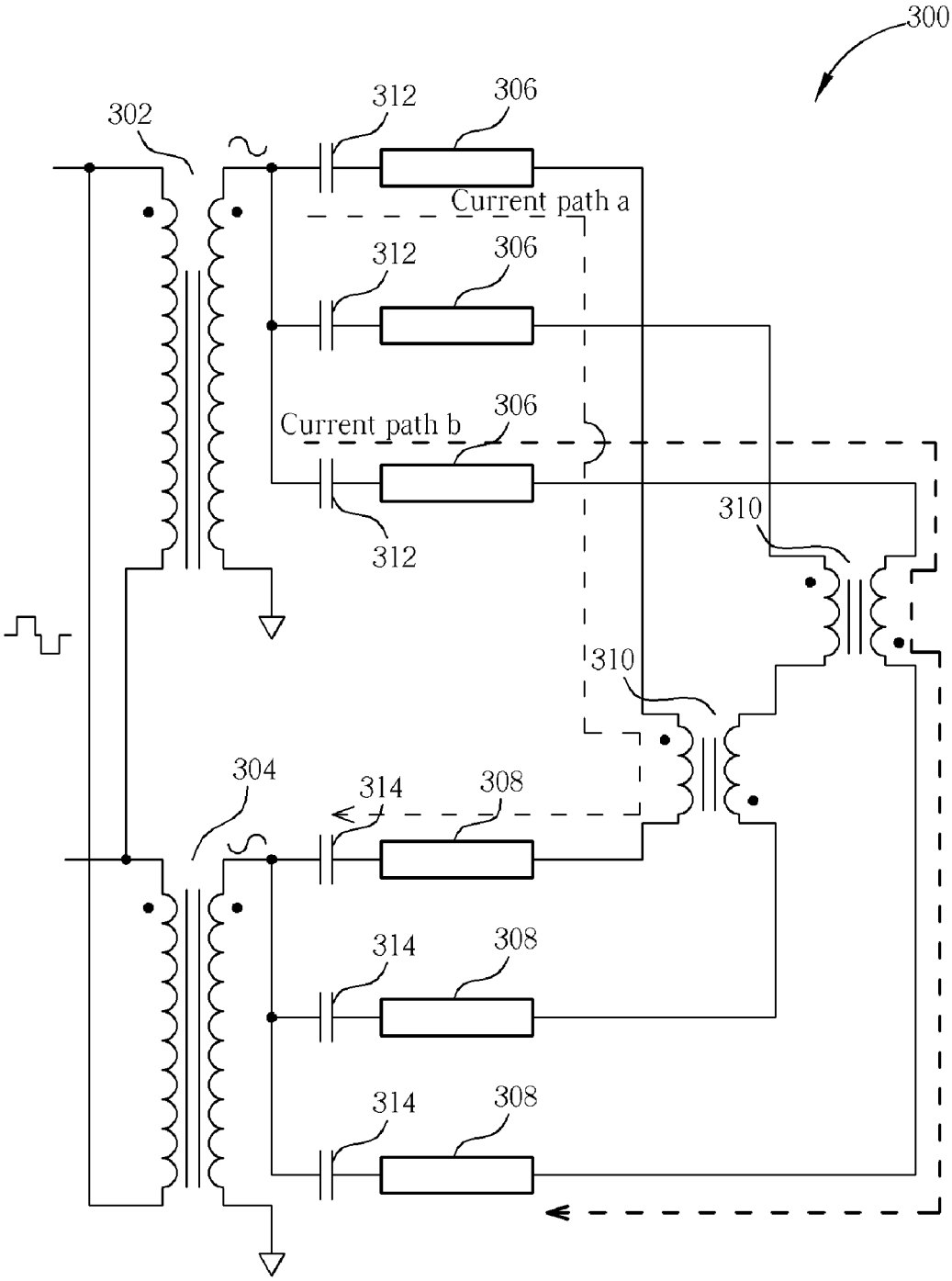
FIG. 3 is a diagram of a current balancing module of the present invention, where a number of utilized balancing transformers is one less than half of the number of tubes.

Please refer to FIG. 3, which is a diagram of a current balancing module 300 of the present invention, where a number of utilized balancing transformers is one less than half of the number of tubes. As shown in FIG. 3, the current balancing module 300 includes a first primary transformer 302, a second primary transformer 304, a plurality of first tubes 306, a plurality of second tubes 308, a plurality of balancing transformers 310, a plurality of first capacitors 312, and a plurality of second capacitors 314. Both the first primary transformer 302 and the second primary transformer 304 receive input voltages at primary, and outputs required output voltages at secondary. In the embodiment shown in FIG. 3, input signals, such as square waves, are inputted at both the first terminals and the second terminals of the first primary transformer 302 and the second primary transformer 304. The input signals are then transformed into required driving signals, such as sinusoidal waves. Note that in the current embodiment of the present invention, the input signals are not limited to square waves, which may be generated from a full bridge circuit, where the full bridge circuit may also be replaced with a half bridge circuit, a push-pull circuit, or a ROYER circuit by those who are skilled in the art.

The first primary transformer 302 has a first input terminal coupled to a second terminal of the second primary transformer 304, and a second input terminal coupled to a first input terminal of the second primary transformer 304. Both the second output terminals of the first primary transformer 302 and the second primary transformer 304 are coupled to ground. Two sinusoidal waves are respectively generated at the first output terminals of the first primary transformer 302 and the second primary transformer 304, where both the sinusoidal waves have same magnitudes and opposite poles.

Each first capacitor 312 has a first terminal coupled to the first output terminal of the first primary transformer 302 for filtering off unnecessary noises. Similarly, each second capacitor 314 has a first terminal coupled to the first output terminal of the second primary transformer for filtering off noises as well. Each first tube 306 has a first terminal coupled to a second terminal of a corresponding first capacitor 312, and a second terminal coupled to one side of a corresponding balancing transformer 310. Each second tube 308 has a first terminal coupled to the second terminal of a corresponding second capacitor 314, and a second terminal coupled to one side of a corresponding balancing transformer 310. In a preferred embodiment of the present invention, all the balancing transformers 310 have a same number of turns (or circles) so as to have a same resistance. Note that each balancing transformer 310 provides two current paths for coupling a first tube 306 and a corresponding second tube 308 in series. Under such conditions, the magnitude of the current on each current path is constrained to be equivalent. In other words, the currents flowing on a same current path through a first primary transformer 306 and a corresponding second primary transformer 308 have a same magnitude. Therefore, except for balancing the magnitude of the currents flowing through each tube, which is the primary aim of the present invention, since the first primary transformer 302 and the second primary transformer 304 provide sinusoidal waves having a same magnitude but opposite poles, the number of utilized balancing transformers 310 is decreased to at most half of the utilized balancing transformers of the conventional current balancing modules. Moreover, in the prior art, a single primary transformer is utilized for driving a plurality of tubes so that specifications (such as high output voltages, volume, or power consumption) of the utilized transformer are more strictly regulated, and such an appropriate transformer is not easily available. On the contrary, since the plurality of tubes is driven by both the primary transformers 302 and 304 providing two sinusoidal waves having same magnitudes and opposite poles in the present invention, both the primary transformers 302 and 304 are less strictly regulated in specifications. For example, both the primary transformers 302 and 304 may be implemented with transformers having lower output voltages for increasing the convenience.

Note that numbers of the plurality of tubes 306, the plurality of balancing transformers 310, the plurality of the first capacitors 312, and the plurality of second capacitors 314 utilized in the current balancing module 300 are not restricted by as shown in FIG. 3. In other words, the numbers of the listed elements are not limited to 2, as illustrated in FIG. 3, and are able to be inducted mathematically. Embodiments corresponding to larger numbers of the listed elements are not illustrated for brevity, but should also be considered in the present invention. Under such conditions, when a sum of the numbers of the plurality of first tubes 306 and the plurality of second tubes 308 is assumed to be n, which is a positive integer, a number of utilized balancing transformers 310 in the current balancing module 300 should be $n/2-1$.

Note that all the first primary transformer 302, the second primary transformer 304, and the plurality of balancing transformers 310 may be implemented with other available transforming elements, which are known by those who are skilled in the art. Therefore, replacements of the listed transformers in the current balancing module 300 should also be embodiments of the present invention. Moreover, the tubes in the current balancing module 300 of the present invention may also be replaced with other passive elements or passive devices, both of which are supplied with external power to operate.

Figure 4:
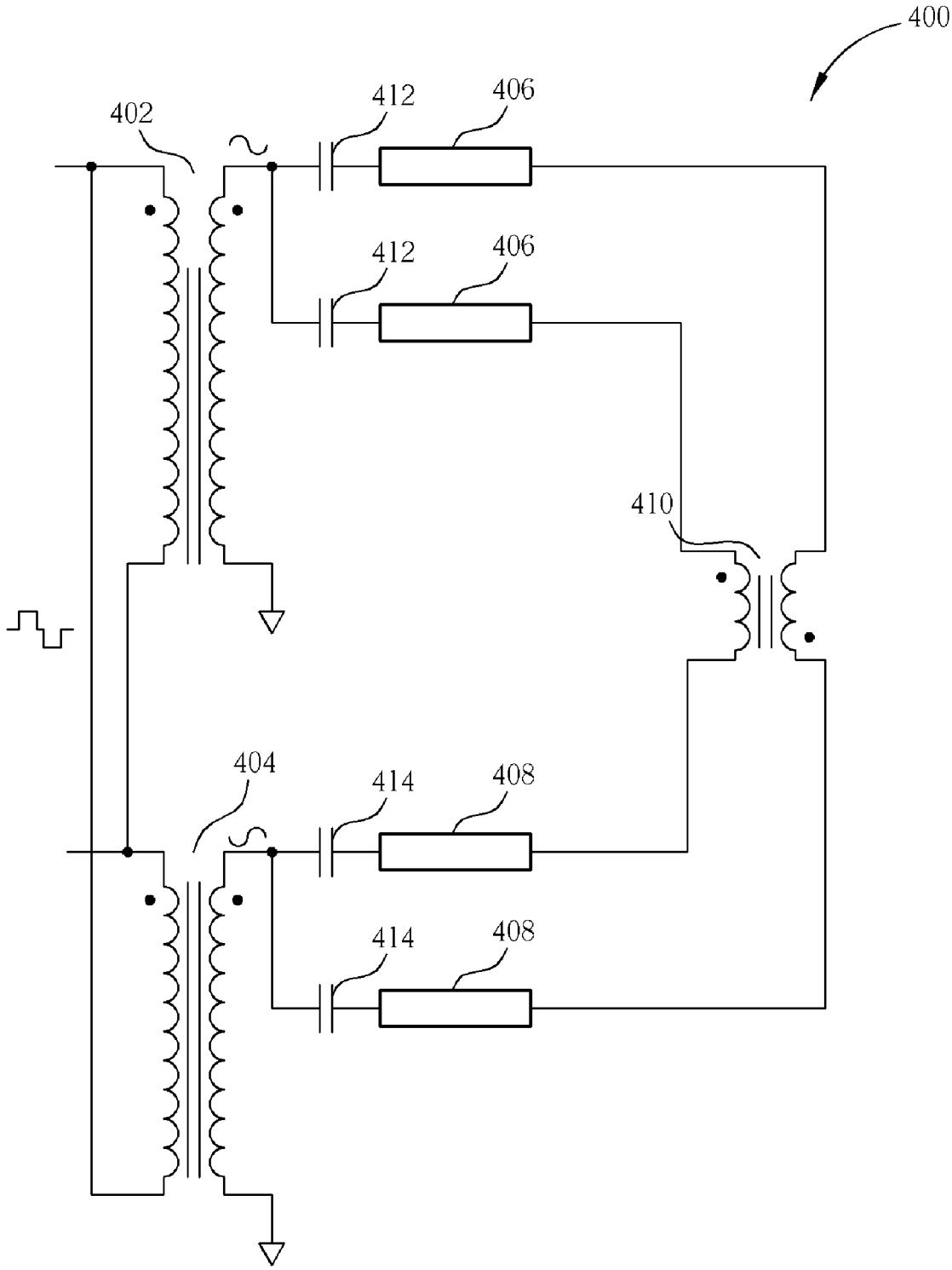
FIG. 4 is a diagram of a current balancing module of the present invention, where the current balancing module is generated by utilizing merely one balancing transformer in the current balancing module shown in FIG. 3.

Please refer to FIG. 4, which is a diagram of a current balancing module 400 of the present invention, where the current balancing module 400 is generated by utilizing merely one balancing transformer 310 in the current balancing module 300 shown in FIG. 3. As shown in FIG. 4, the current balancing module 400 includes a first primary transformer 402, a second primary transformer 404, two first tubes 406, two second tubes 408, a balancing transformer 410, two first capacitors 412, and two second capacitors 414. Couplings of most elements shown in FIG. 4 are similar with the couplings of most elements shown in FIG. 3, and are not repeatedly described for brevity. In other words, the current balancing module 400 may be inducted form the current balancing module 300 shown in FIG. 3. Considering the number of utilized tubes in the current balancing module 400, when the number of utilized balancing transformers is merely one (1=n/2−1), the number of utilized tubes should be four (n=4), which is just the sum of the numbers of the plurality of first tubes 406 and the plurality of second tubes 408. Similarly, since the number of the plurality of first capacitors 412 corresponds to the number of first tubes 406, and since the number of the plurality of second capacitors 414 corresponds to the number of second tubes 408, the numbers of both the plurality of first capacitors 412 and the plurality of second capacitors 414 should be two. Operations of the listed elements are not repeatedly described for brevity.

Figure 5:
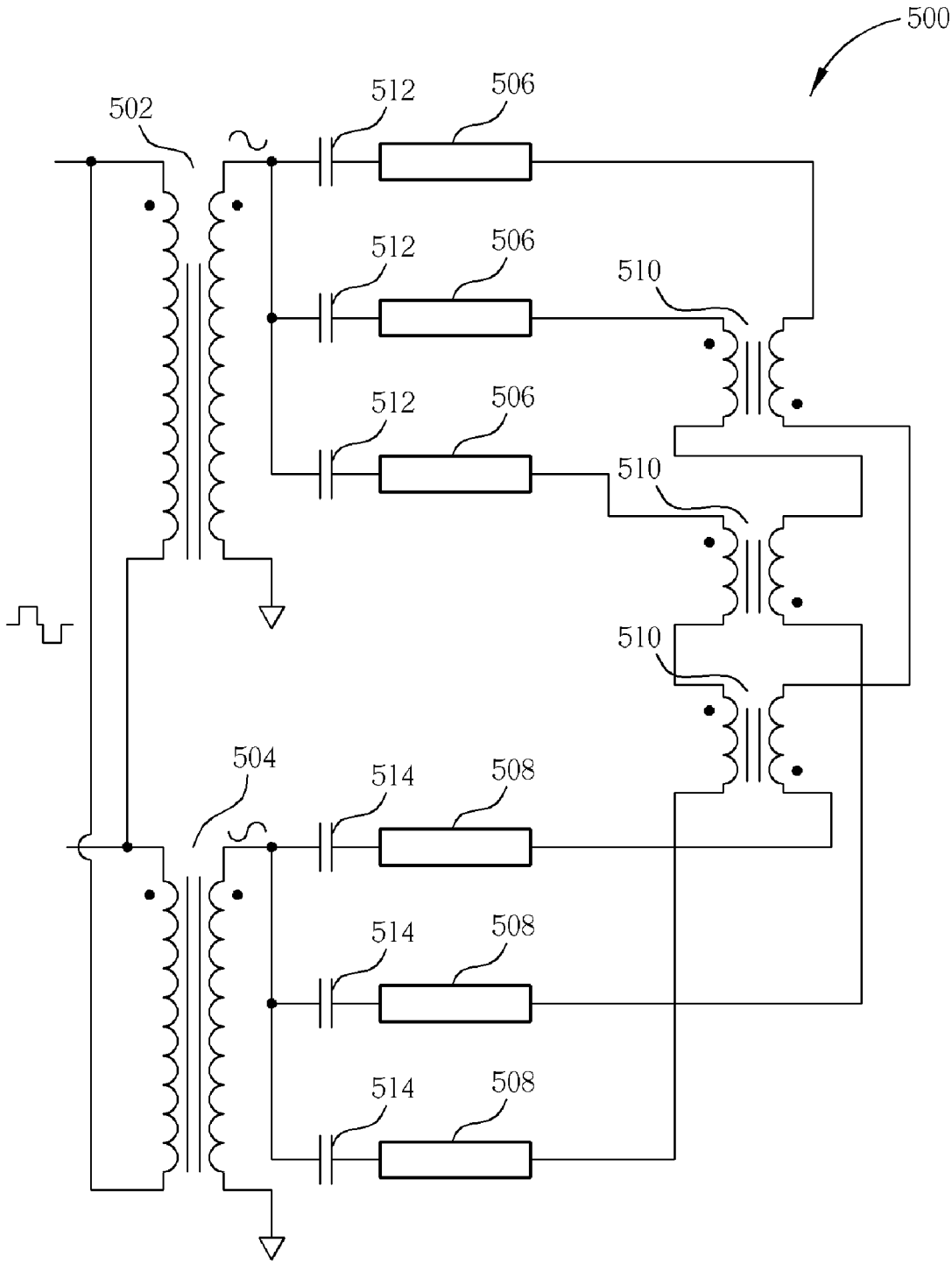
FIG. 5 is a diagram of a current balancing module of the present invention, where a number of utilized balancing transformers is half of a number of utilized tubes.

According to other embodiments inducted from the current balancing module 300 shown in FIG. 3, most current paths pass through two balancing transformers 310, whereas there are still two current paths passing through merely one balancing transformer 310, i.e., the current path a and the current path b shown in FIG. 3. Though the current paths a and b put tiny effects on balancing magnitudes of currents flowing through the plurality of tubes 306, the current balancing module 300 may still be improved to reach better balance, where the improvement is illustrated in FIG. 5. Please refer to FIG. 5, which is a diagram of a current balancing module 500 of the present invention, where a number of utilized balancing transformers is half of a number of utilized tubes. As shown in FIG. 5, the current balancing module 500 includes a first primary transformer 502, a second primary transformer 504, a plurality of first tubes 506, a plurality of second tubes 508, a plurality of balancing transformers 510, a plurality of first capacitors 512, and a plurality of second capacitors 514. Similar with descriptions related to the current balancing module 300 shown in FIG. 3, both the first primary transformer 502 and the second primary transformer 504 are utilized for providing a pair of sinusoidal waves having same magnitudes and opposite poles. The first primary 502 has a first input terminal coupled to a second input terminal of the second primary transformer 504, and a second input terminal coupled to a first input terminal of the second primary transformer 504. Each of the plurality of first capacitors 512 has a first terminal coupled to a first output terminal of the first primary transformer 502. Both the first primary transformer 502 and the second primary transformer 504 have a second output terminal coupled to ground. Each of the plurality of first tubes 506 has a first terminal coupled to a second terminal of a corresponding first capacitor 512, and a second terminal coupled to one side of a corresponding balancing transformer 510. Similarly, each of the plurality of second tubes 508 has a first terminal coupled to a second terminal of a corresponding second capacitor 514, and a second terminal coupled to one side of a corresponding balancing transformer 510. Most couplings and the principle for balancing magnitudes of currents of the current balancing module 500 are similar with as described in the current balancing module 300 as shown in FIG. 3 so that repeated descriptions are omitted for brevity. As can be observed in the current balancing module 500, a number of the plurality of balancing transformers 510 is half of a sum of numbers of the plurality of first tubes 506 and the plurality of second tubes 508, and every current path in the current balancing module 500 flows through two balancing transformers 510. In comparison with the current balancing module 300 shown in FIG. 3, though the number of utilized balancing transformers is increased by 1, the aim of balancing magnitudes of currents flowing through every tubes 506 and 508 is certainly achieved. Note that when a sum of numbers of both the plurality of first tubes 506 and the plurality of second tubes 508 is assumed to be a positive integer n, a number of utilized balancing transformers 510 is n/2.

In the above-disclosed embodiments of the present invention, each balancing transformer is disposed between a corresponding first tube and a corresponding second tube. However, each balancing transformer may also be disposed on any position between the first output terminal of the first primary transformer and the first output terminal of the second primary transformer, and the aim of balancing magnitudes of currents may still be achieved.

Figure 6:
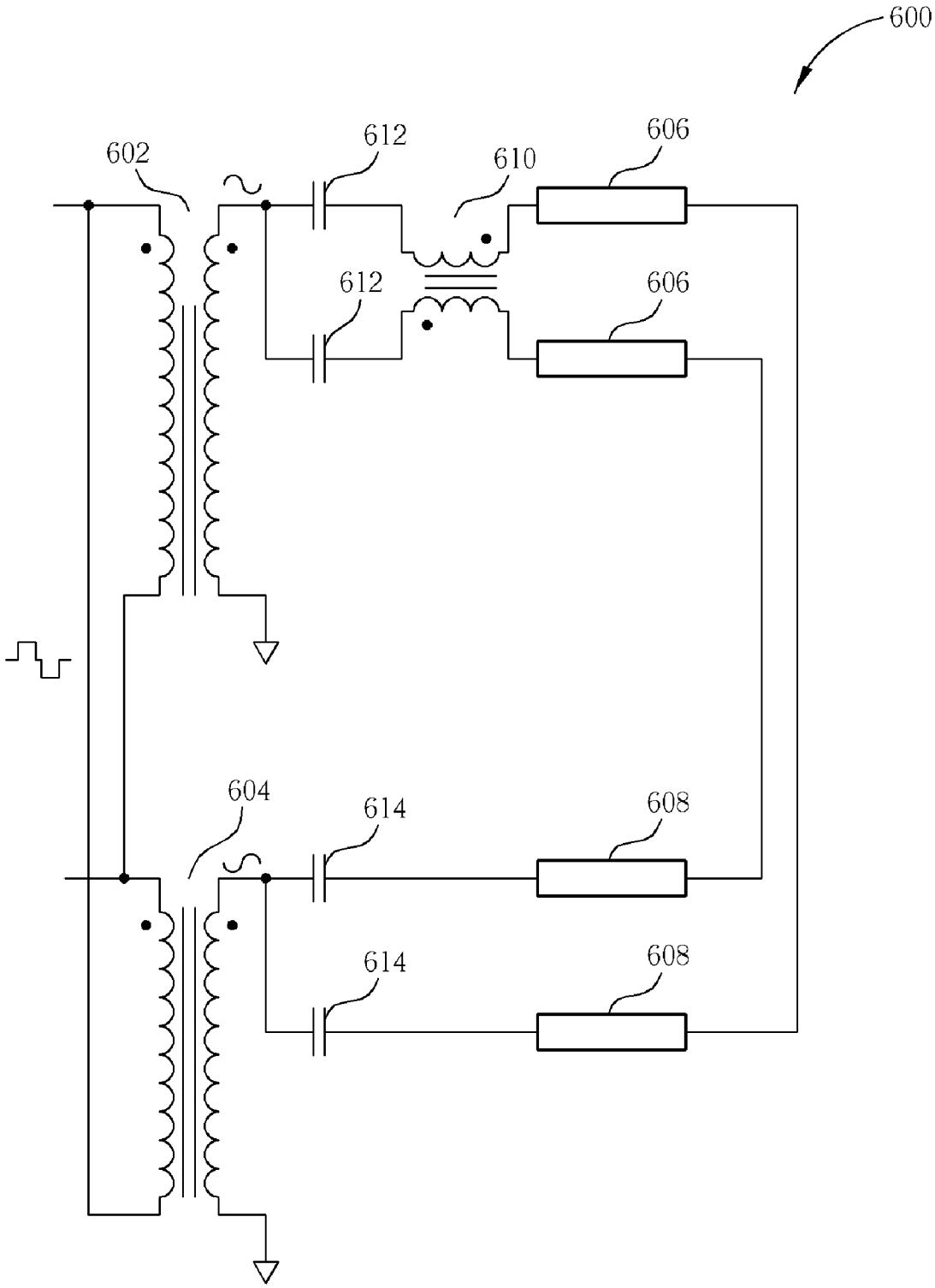
FIG. 6 is a diagram of a current balancing module of the present invention, where the current balancing module is generated by disposing each balancing transformer between a corresponding first capacitor and a corresponding first tube in the current balancing module shown in FIG. 4.

Please refer to FIG. 6, which is a diagram of a current balancing module 600 of the present invention, where the current balancing module 600 is generated by disposing each balancing transformer 410 between a corresponding first capacitor 412 and a corresponding first tube 406 in the current balancing module 400 shown in FIG. 4. The current balancing module 600 includes a first primary transformer 602, a second primary transformer 604, two first tubes 606, two second tubes 608, a balancing transformer 610, two first capacitors 612, and two second capacitors 614. Most couplings in the current balancing module 600 are the same as most couplings in the current balancing module 400 shown in FIG. 4, except for the disposition of the balancing transformer 610, so that repeated descriptions about couplings are not described for brevity. Note that in FIG. 6, when the number of utilized tubes is a positive integer n, the number of utilized balancing transformers is n/2−1.

Figure 7:
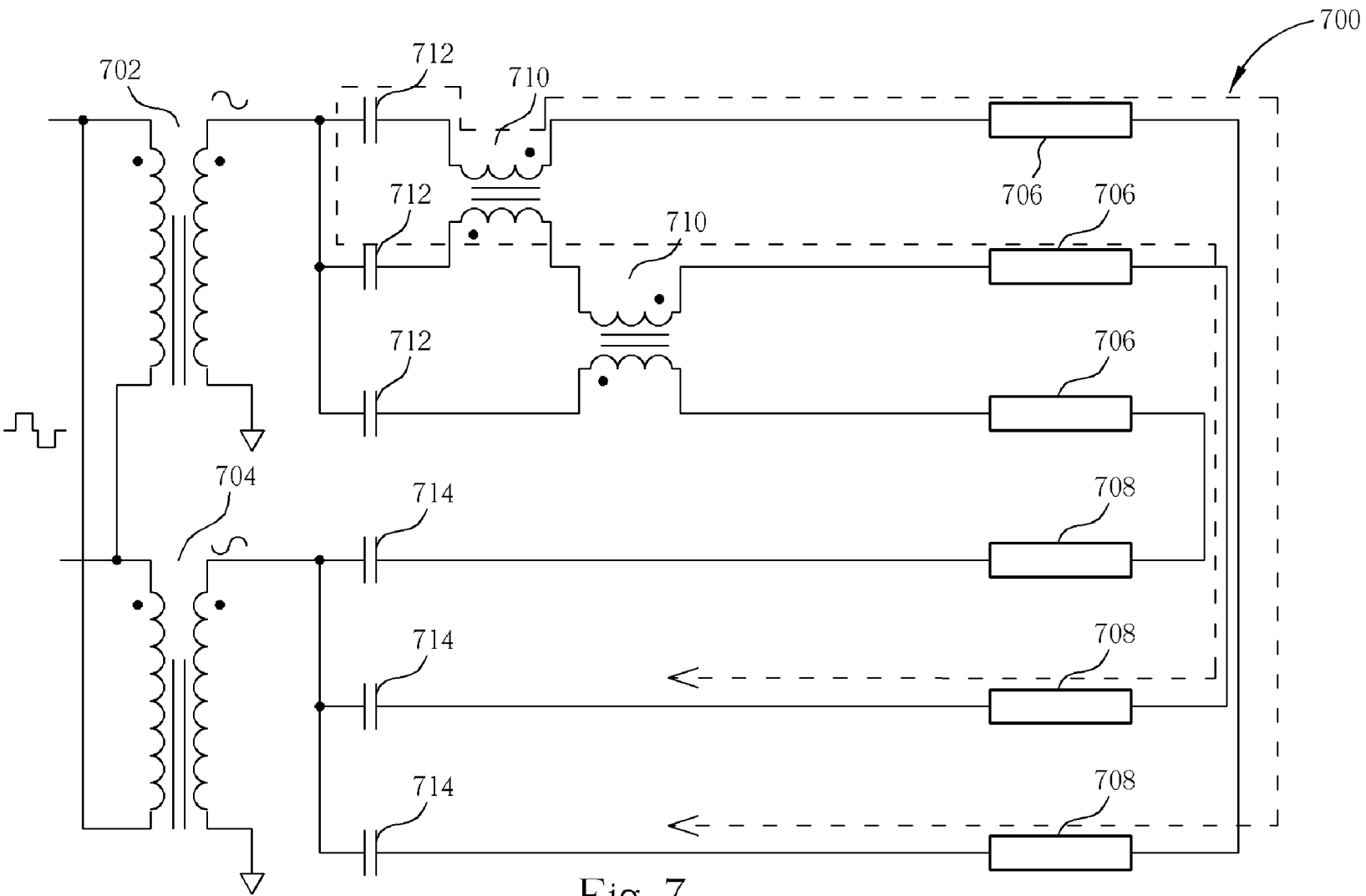
FIG. 7 is a diagram of a current balancing module of the present invention, where the current balancing module is generated by disposing each balancing transformer between a corresponding first capacitor and a corresponding first tube.

Please refer to FIG. 7, which is a diagram of a current balancing module 700 of the present invention, where the current balancing module 700 is generated by disposing each balancing transformer 310 between a corresponding first capacitor 312 and a corresponding first tube 306. As shown in FIG. 7, the current balancing module 700 includes a first primary transformer 702, a second primary transformer 704, a plurality of first tubes 706, a plurality of second tubes 708, a plurality of balancing transformers 710, a plurality of first capacitors 712, and a plurality of second capacitors 714. Most couplings and the principle for balancing magnitudes of currents in the current balancing module 700 are similar with those in the current balancing module 300 shown in FIG. 3, and are not described further for brevity. Note that though the numbers of the plurality of first tubes 706, the plurality of second tubes 708, the plurality of first capacitors 712, and the plurality of second capacitors 714 are three, other embodiments of the present invention having more than three the listed elements should be easily inducted. When the sum of the numbers of the plurality of first tubes 706 and the plurality of second tubes 708 is a positive integer n, the number of utilized balancing transformers 710 should be n/2−1. Note that in FIG. 7, there are still two current paths passing through merely one balancing transformer 710, whereas all the other current paths pass through at least two and an equal number of balancing transformers 710, and it indicates a same condition previously described in FIG. 3.

Figure 8:
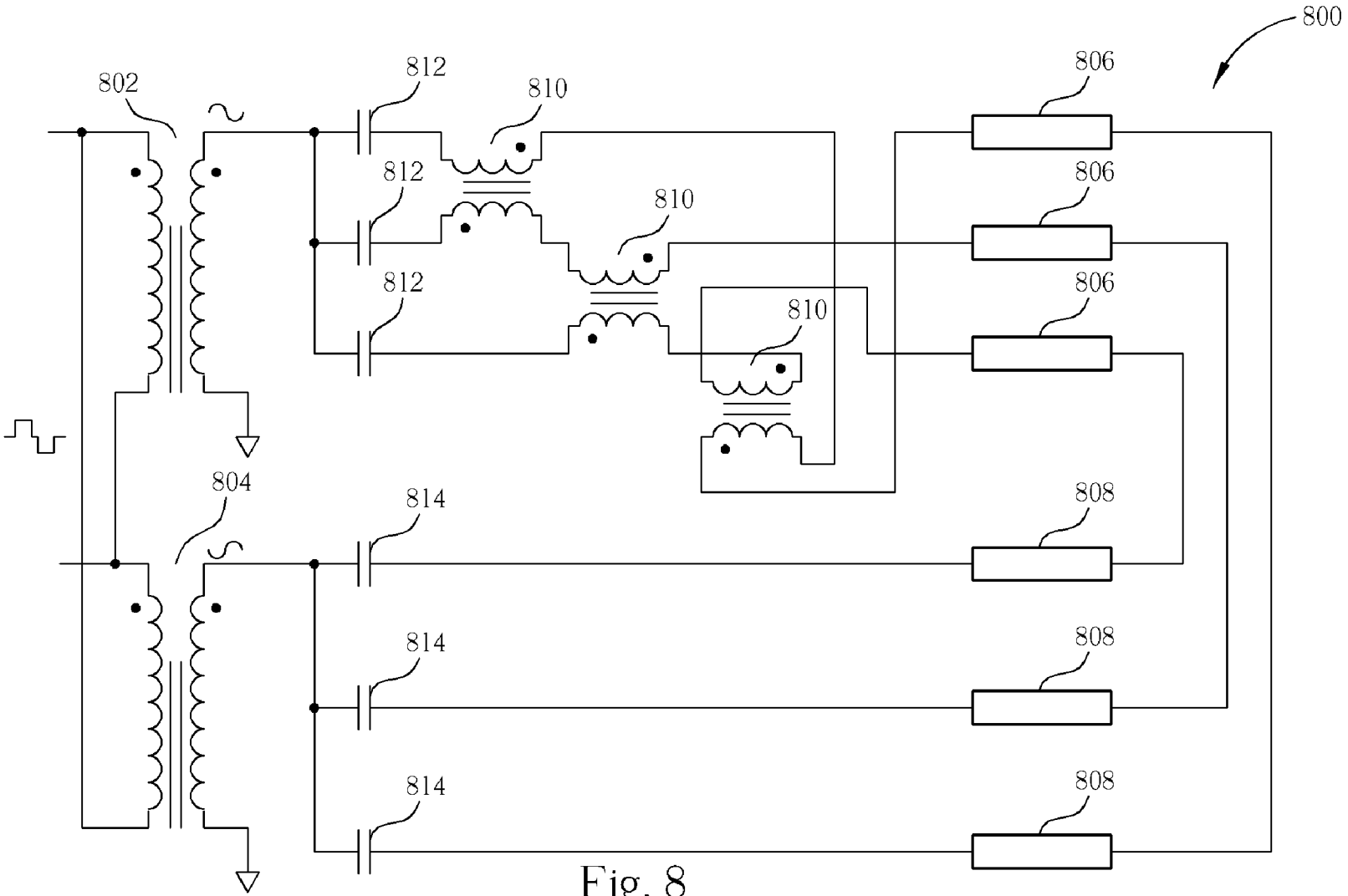
FIG. 8 is a diagram of a current balancing module of the present invention, where the current balancing module is generated by disposing each balancing transformer between a corresponding first capacitor and a corresponding first tube in the current balancing module shown in FIG. 5.

Please refer to FIG. 8, which is a diagram of a current balancing module 800 of the present invention, where the current balancing module 800 is generated by disposing each balancing transformer 510 between a corresponding first capacitor 512 and a corresponding first tube 506 in the current balancing module 500 shown in FIG. 5. As shown in FIG. 8, the current balancing module 800 includes a first primary transformer 802, a second primary transformer 804, a plurality of first tubes 806, a plurality of second tubes 808, a plurality of balancing transformers 810, a plurality of first capacitors 812, and a plurality of second capacitors 814. Most couplings and the principle for balancing magnitudes of currents in the current balancing module 800 are similar with those in the current balancing module 500 shown in FIG. 5, except for the disposition of each balancing transformer 810, so that repeated descriptions are not disclosed for brevity. Note that when a sum of the numbers of the plurality of first tubes 806 and the plurality of second tubes 808 is a positive integer n, the number of the utilized balancing transformers 810 is n/2. Moreover, no current path in the current balancing module 800 passes through merely one balancing transformer 810, and each current path in the current balancing module 800 passes through a same number of balancing transformers 810.

Figure 9:
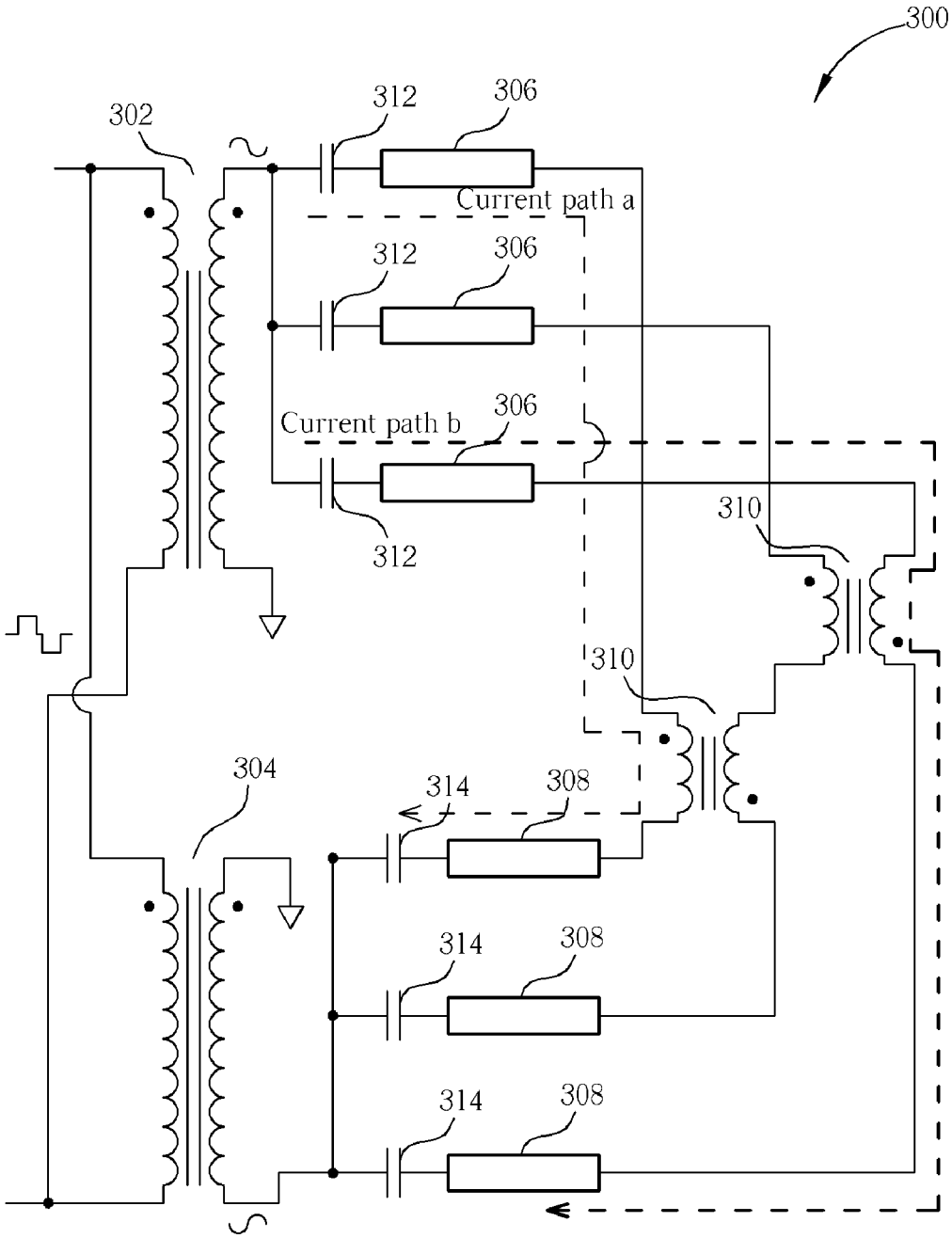
FIG. 9 is a diagram of coupling the second primary transformer in a reversed manner in the current balancing module shown in FIG. 3.

Though in the abovementioned current balancing modules of the present invention, the first input terminal of the second primary transformer is a positive input terminal, and the second input terminal of the second primary transformer is a negative input terminal (meanwhile, the first output of the second primary transformer is a positive output terminal, and the second output terminal of the second primary transformer is a negative output terminal), the second primary transformer may still be coupled in a reversed manner for generating the pair of sinusoidal waves having same magnitudes and opposite poles with the first primary transformer. Please refer to FIG. 9, which is a diagram of coupling the second primary transformer 304 in a reversed manner in the current balancing module 300 shown in FIG. 3. As shown in FIG. 9, the second primary transformer 304 has a positive input terminal coupled to a positive input terminal of the first primary transformer 302, and a negative input terminal coupled to a negative input terminal of the first primary transformer 302. Both a negative output terminal of the first primary transformer 302 and a positive output terminal of the second primary transformer 304 are coupled to ground. The second primary transformer 304 has a negative output terminal coupled to the first terminal of each second tube 308. The second primary transformer in the current balancing modules shown in FIG. 4, FIG. 5, FIG. 6, FIG. 7, and FIG. 8 may also be coupled in a reversed manner without affecting the balances in the magnitudes of currents, and related embodiments of the present invention are not further illustrated for brevity.

In summary, the present invention discloses a current balancing module for constraining the magnitude of the current on each current path to be equal with a pair of sinusoidal waves having same magnitudes and opposite poles, where the pair of sinusoidal waves is generated with the aid of two primary transformers and a plurality of balancing transformers having a same number of turns in the disclosed current balancing module of the present invention. Therefore, in comparison to the conventional current balancing modules of the prior art, the aim of balancing magnitudes of currents may still be achieved while the number of balancing transformers is significantly decreased. The defect of complicated designs and increased volumes, which are caused by adding tubes, in the conventional current balancing modules, which are applied on liquid crystal televisions, is also compensated in the present invention.

Those skilled in the art will readily observe that numerous modifications and alterations of the device and method may be made while retaining the teachings of the invention.

What is claimed is:

1. A current balancing module comprising:

a first transforming element having a first input terminal and a second input terminal;

a second transforming element having a first input terminal coupled to the second input terminal of the first transforming element, and a second input terminal coupled to the first input terminal of the first transforming element;

a plurality of first passive devices, each of which has a first terminal coupled to the first output terminal of the first transforming element;

a plurality of second passive devices, each of which has a first terminal coupled to the first output terminal of the second transforming element, and a second terminal coupled to the second terminal of a corresponding first passive device; and a plurality of third transforming elements, each of which has a side connected in series with a corresponding first passive device and a corresponding second passive device.

2. The current balancing module of claim 1 wherein the first input terminal of the first transforming element is a positive input terminal, the second input terminal of the first transforming element is a negative input terminal, the first output terminal of the first transforming element is a positive output terminal, and the second output terminal of the first transforming element is a negative output terminal.

3. The current balancing module of claim 2 wherein the first input terminal of the second transforming element is a positive input terminal, the second input terminal of the second transforming element is a negative input terminal, the first output terminal of the second transforming element is a positive output terminal, and the second output terminal of the second transforming element is a negative output terminal.

4. The current balancing module of claim 2 wherein the first input terminal of the second transforming element is a negative input terminal, the second input terminal of the second transforming element is a positive input terminal, the first output terminal of the second transforming element is a negative output terminal, and the second output terminal of the second transforming element is a positive output terminal.

5. The current balancing module of claim 1 wherein the number of circles of the first transforming element is the same as the number of circles of the second transforming element.

6. The current balancing module of claim 1 wherein one of the plurality of first transforming elements is coupled with one of the plurality of second transforming elements.

7. The current balancing module of claim 1 wherein both the second output terminal of the first transforming element and the second output terminal of the second transforming element are coupled to ground.

8. The current balancing module of claim 1 wherein the number of the plurality of third transforming elements equals one less than half of the sum of the numbers of the plurality of first passive devices and the plurality of second passive devices; wherein one side of each the third transforming element is coupled to both a corresponding first passive device and a corresponding second passive device.

9. The current balancing module of claim 1 wherein the number of the plurality of third transforming elements equals half of the sum of the numbers of the plurality of first passive devices and the plurality of second passive devices; wherein two third transforming elements are coupled to a first passive device and a second passive device, which corresponds to the coupled first passive device.

10. The current balancing module of claim 1 wherein one of the plurality of first passive devices is coupled to corresponding one of the plurality of second passive devices through one side of two third transforming elements.

11. The current balancing module of claim 1 further comprising:

a plurality of first capacitors, each of which has a first terminal coupled to the first output terminal of the first transforming element, and a second terminal coupled to the first terminal of a corresponding first passive device; and a plurality of second capacitors, each of which has a first terminal coupled to the first output terminal of the second transforming element, and a second terminal coupled to the first terminal of a corresponding second passive device.

12. The current balancing module of claim 11 wherein the number of the plurality of third transforming devices equals one less than half of the sum of the numbers of the plurality of first passive devices and the plurality of second passive devices; each third transforming element has one side coupled to both a corresponding first passive device and a corresponding first capacitor; and the first passive device is coupled to both a corresponding third transforming element and a corresponding second passive device.

13. The current balancing module of claim 11 wherein the number of the plurality of third transforming element equals half of the sum of the numbers of the plurality of first passive devices and the plurality of second passive devices; each third transforming element has one side coupled to a corresponding first passive device and a corresponding first capacitor; and each passive device is coupled to a corresponding third transforming element and a corresponding second passive device.

14. The current balancing module of claim 1 wherein specifications of both the first passive device and the second passive device are the same.

15. The current balancing module of claim 14 wherein both the first passive device and the second passive device are tubes.

16. A current balancing module comprising:

a first transforming element having a first input terminal and a second input terminal;

a second transforming element having a first input terminal coupled to the second input terminal of the first transforming element, and a second input terminal coupled to the first input terminal of the first transforming element;

two first passive devices, each of which has a first terminal coupled to the first output terminal of the first transforming element;

two second passive devices, each of which has a first terminal coupled to the first output terminal of the second transforming element, and a second terminal coupled to the second terminal of a corresponding first passive device; and a third transforming element having one side coupled in series with both the first corresponding passive device and a second corresponding passive device.

17. The current balancing module of claim 16 wherein the first input terminal of the first transforming element is a positive input terminal, the second input terminal of the first transforming element is a negative input terminal, the first output terminal of the first transforming element is a positive output terminal, and the second output terminal of the first transforming element is a negative output terminal.

18. The current balancing module of claim 17 wherein the first input terminal of the second transforming element is a positive input terminal, the second input terminal of the second transforming element is a negative input terminal, the first output terminal of the second transforming element is a positive output terminal, and the second output terminal of the second transforming element is a negative output terminal.

19. The current balancing module of claim 17 wherein the first input terminal of the second transforming element is a negative input terminal, the second input terminal of the second transforming element is a positive input terminal, the first output terminal of the second transforming element is a negative output terminal, and the second output terminal of the second transforming element is a positive output terminal.

20. The current balancing module of claim 19 wherein the number of circles of the first transforming element equals the number of circles of the second transforming element.

21. The current balancing element of claim 16 wherein both the second output terminals of the first transforming element and the second transforming element are coupled to ground.

22. The current balancing module of claim 16 wherein the first passive device is coupled to a corresponding second passive device through one side of the third transforming element.

23. The current balancing module of claim 16 further comprising:

two first capacitors, each of which has a first terminal coupled to the first output terminal of the first transforming element, and a second terminal coupled to the first terminal of a corresponding first passive device; and two second capacitors, each of which has a first terminal coupled to the first output terminal of the second transforming element, and a second terminal coupled to the first terminal of a corresponding second passive device.

24. The current balancing module of claim 23 wherein the third transforming element has one side coupled to a corresponding first passive device and the first capacitor; wherein the first passive device is coupled to the third transforming element and a corresponding second passive device.

25. The current balancing module of claim 16 wherein one side of the third transforming element is coupled to both a first passive device and a second passive device.

* * * * *